US007950176B1

(12) United States Patent
Nemtyshkin et al.

(10) Patent No.: US 7,950,176 B1
(45) Date of Patent: May 31, 2011

(54) HANDHELD MULTIPLE-CHARGE WEAPON FOR REMOTE IMPACT ON TARGETS WITH ELECTRIC CURRENT

(76) Inventors: Oleg Nemtyshkin, Toliatty (RU); Yury Ladyagin, Moscow (RU)

( * ) Notice: Subject to any disclaimer, the term of this patent is extended or adjusted under 35 U.S.C. 154(b) by 609 days.

(21) Appl. No.: 11/560,888

(22) Filed: Nov. 17, 2006

(51) Int. Cl.
*F41C 9/00* (2006.01)

(52) U.S. Cl. ..... 42/1.08; 361/232

(58) Field of Classification Search ..... 42/1.08, 42/6, 49.01, 50; 361/232; 89/195, 197, 33.01, 89/33.02, 33.1
See application file for complete search history.

(56) References Cited

U.S. PATENT DOCUMENTS

| | | | | |
|---|---|---|---|---|
| 3,921,614 | A * | 11/1975 | Fogelgren | 102/448 |
| 4,253,132 | A * | 2/1981 | Cover | 361/232 |
| 5,698,815 | A * | 12/1997 | Ragner | 361/232 |
| 5,747,719 | A * | 5/1998 | Bottesch | 89/1.1 |
| 6,575,073 | B2 * | 6/2003 | McNulty et al. | 89/1.11 |
| 6,636,412 | B2 * | 10/2003 | Smith | 361/232 |
| 6,862,994 | B2 * | 3/2005 | Chang | 42/1.08 |
| 6,880,466 | B2 * | 4/2005 | Carman | 42/1.08 |
| 7,065,915 | B2 * | 6/2006 | Chang | 42/84 |
| 7,096,792 | B1 * | 8/2006 | Carman | 42/1.08 |
| 7,114,450 | B1 * | 10/2006 | Chang | 361/232 |
| 2004/0017178 | A1 * | 1/2004 | Chang | 320/114 |
| 2005/0188887 | A1 * | 9/2005 | Chang | 102/502 |
| 2006/0120009 | A1 * | 6/2006 | Chudy | 42/1.08 |

* cited by examiner

*Primary Examiner* — Michael Carone
*Assistant Examiner* — Jonathan C Weber
(74) *Attorney, Agent, or Firm* — Ishman Law Firm P.C.

(57) ABSTRACT

A handheld multiple-charge weapon for remote impact on a target with an electric current includes a housing including a launch power supply, a power source, a voltage converter, and a high voltage generator and triggered by a firing element. A clip on the housing carries a plurality of unitary cartridges. Each of said cartridges carries an electrode for contact action on the target and delivering the electric current thereto. The cartridge includes a wire connected to an electrode launched from each of at least two of said cartridges by the power source toward the target when the firing element is actuated in a firing position. The clip moves two cartridges to the firing position and after the firing element is actuated extracts the cartridges and associated wires. The wires are connected to the high voltage generator subsequent to the firing element being actuated after which the cycle of firing and extraction of spent cartridges can be repeated multiple times in manual, semiautomatic or automatic mode.

22 Claims, 9 Drawing Sheets

HANDHELD MULTIPLE-CHARGE WEAPON FOR REMOTE IMPACT ON TARGETS WITH ELECTRIC CURRENT

FIELD OF THE INVENTION

The invention relates to weapons that use electrical means to engage a target and, in particular, to a multiple cartridge clip for remote electric current weapons.

BACKGROUND OF THE INVENTION

A well-known device is the "Advanced Taser M-26", described in U.S. Pat. No. 6,636,412 and chosen by the applicant as a prototype. This device hits the target, usually implied to be a biological subject, with electric shock by closing the circuit of a high-voltage generator through the subject's body, using electric wires launched by a pneumatic power source. Electric shock occurs upon attaching to the subject two launched projectiles, each of which is connected by an electric wire to a corresponding cartridge contact, to which electric potential is fed from a high-voltage generator situated within the device. The cartridge is secured within the device by using a mechanical connector, and the power source that launches the projectiles is actuated when electric potential from the high-voltage generator is fed to the cartridge contacts.

This device has the following drawbacks:

1. The device has a single cartridge, which is rigidly fastened to the device using a mechanical connector, which significantly limits the possibility of firing a second shot. In order to fire a second shot, the shooter must disconnect the spent cartridge and attach a new one. Moreover, in order to change the cartridge, the shooter is forced to engage his other hand, which could be injured or occupied with a control weapon (usually a firearm).

2. Another drawback is the fact that a device with an attached cartridge cannot be used in a contact manner without triggering the cartridge launching source. In order to use the device in a contact manner without firing it, one must first detach the cartridge, which is time-consuming, and again engage one's other hand.

SUMMARY OF THE INVENTION

The purpose of the invention is to create a handheld multiple-charge remote weapon with an electric strike medium that is operated with one hand and has a high rate of fire and the ability to select the contact or remote mode of use as desired. The invention also has the goal of increasing the firing accuracy and effectiveness, striking distance, and effectiveness of the electrical impact on the subject. The weapon's multiple charge feature is achieved by having the launching elements for the electric wire made in the form of unitary cartridges, minimizing weight and size. The unitary cartridges are sited in the device's fixed magazine or detachable clip. The design of the cartridges used in the weapon is described in detail in Russian Federation patent applications Nos. 200511259, 200511260 and 2005113206.

The high rate of fire of the weapon's manual version, which uses the shooter's muscle power, is achieved by the fact that firing is accomplished with a long squeeze of the firing element, while the extraction of the spent cartridges along with the electric wires occurs upon releasing the firing element. In the weapon's semiautomatic version, firing is accomplished with a brief squeeze of the firing element, while the cartridges are advanced to the firing position and extracted automatically. In the weapon's automatic version, firing and extraction are accomplished automatically while the firing element remains depressed.

The ability to select the contact or remote mode of use as desired is ensured by the fact that high voltage can be fed to the device's electrodes, which are designed for contact action on the subject, without advancing the cartridges into the firing position.

The operation of the firing element during firing, extraction of the spent cartridges, and also the feeding of high voltage to the device's contact electrodes without firing a shot, can be performed with the same hand in which the shooter holds the weapon.

Increased firing accuracy and strike radius are achieved by the fact that the launched projectiles travel along guide channels that are in fact a type of barrel. The guide channels provide supplemental stabilization for the launched projectiles, reducing their initial dispersion and thereby increasing the projectiles' target accuracy.

In the "Advanced Taser M-26" device, the launched projectiles travel with an angular spread of 8 degrees. The projectiles' angular spread produces an increase in the distance between the points where the electric shock is applied to the subject when the projectiles attach to the subject. This increases the effect, due to the increased length of the contour (the current loop) along which the electric shock current flows. If the angular spread between the projectiles is absent, the "Advanced Taser M-26" device could be ineffective due to the slight initial separation between the projectiles, which comprises about 25 mm. At the same time, the presence of the angular spread between the projectiles limits the effective striking distance, since the spread between the projectiles increases with distance, sharply reducing the probability that both projectiles will hit the target.

In the weapon submitted here, used to fire two unitary cartridges, the launched projectiles are separated one from another at a maximum distance determined by the weapon's dimensions, amounting to 100-120 mm or more. The large initial separation between the projectiles makes it possible to achieve a high degree of strike effectiveness with a negligible angular spread of 1-2 degrees, or the complete absence of such a spread. The small angular spread or absence thereof allows one to increase the probability that both projectiles will hit the target at greater distances.

Firing effectiveness can be increased by using a brief, powerful discharge, the passage of which through the subject's body is synchronized with the moment at which the projectiles strike the target. The subject is struck during a span of time when the launched wires do not cross, in the event that cartridges with non-insulated wires are being used.

The increased strike effectiveness of the weapon submitted here is achieved by using a combined electric charge comprising a series of sequential impulses, in which there is an alternation of impulses that possess various spacing frequencies and induce varied physiological reactions in the subject.

1. One feature of the invention is the fact that the handheld multiple-charge weapon for remote impact on targets with electric current, containing electrodes for contact action on the target and elements for launching electric wires to which a high-voltage current is fed, consisting of a housing, a launch power supply, the launched projectile which serves to deliver and attach the electric wire to the target, power sources, a voltage converter, and a high-voltage generator, situated in the weapon's common housing and triggered by a firing element, is differentiated by the fact that the electric wire's launching elements are made in the form of unitary cartridges that are sited in a fixed magazine or a detachable clip, and the shot is produced when the firing element is depressed, by triggering the power sources for launching the electric wires of at least two cartridges, which are advanced to the firing position and held there while the target is being engaged, and upon releasing the firing element, or automatically after the temporary delay needed to engage the target, the spent cartridges with the electric wires are extracted, after which the cycle of firing and extraction of spent cartridges can be repeated multiple times in manual, semiautomatic or automatic mode.

2. A weapon as in item 1, differing in that the cartridges are advanced to the firing position by a push or pull rod with protrusions that are engaged with the cartridges, or by protrusions of the cartridges when the cartridges are moved to the firing position, and disengage from the cartridges or their protrusions when the push or pull rod returns to the starting position.

3. A weapon as in item 1, differing in that high voltage is delivered to electrodes designed for contact action on the target by means of an independent switch without advancing the cartridges to the firing position.

4. A weapon as in item 1, differing in that the launched projectiles travel in guide channels having a lengthwise straight or spiral open-ended notch for the electric wire to exit when extracting the spent cartridges.

5. A weapon as in items 1 and 4, differing in that the guide channels are made of dielectric material.

6. A weapon as in items 1, 4 and 5, differing in that the high voltage is fed to the launched electric wires at the end of the guide channels near the weapon's muzzle end face.

7. A weapon as in item 1, differing in that the moment when the power sources for launching the cartridges are triggered is synchronized with the moment when high voltage is fed to the electric wires that are being launched from the cartridges.

8. A weapon as in item 1, differing in that the power sources for launching the cartridges are triggered mechanically or electrically.

9. A weapon as in item 1, differing in that the cartridges are placed at the maximum possible distance one from another, as determined by the weapon's dimensions.

10. A weapon as in item 1, differing in that the magazine or clip has a common groove and feed spring, and the cartridges exit the groove in opposite directions.

11. A weapon as in item 1, differing in that the magazine or clip has two mutually isolated grooves with two feed springs, and the cartridges exit the grooves in opposite directions.

12. A weapon as in item 1, differing in that the cartridges situated in the magazine or clip are isolated from the high-voltage discharge circuit.

13. A weapon as in item 1, differing in that the magazine or clip has a multi-row cartridge arrangement.

14. A weapon as in item 1, differing in that the cartridges are advanced into the firing position and/or extracted by the shooter's own muscle power.

15. A weapon as in item 1, differing in that the cartridges are advanced into the firing position and/or extracted by an electromechanical drive.

16. A weapon as in item 1, differing in that the cartridges are advanced into the firing position and/or extracted by retaining part of the energy from the preceding shot, or the energy of an additional pyrotechnic charge located in the cartridge.

17. A weapon as in item 1, differing in that the target is hit by a powerful, momentary electrical charge that is transmitted to the target over a span of time during which no contact or electrical disruption occurs between the launched wires.

18. A weapon as in items 1 and 17, differing in that the moment when the powerful, momentary electrical charge is transmitted through the target is synchronized with the moment the projectiles hit the target.

19. A weapon as in items 1, 17 and 18, differing in that a D/C capacitor is used as the end element of the high-voltage generator.

20. A weapon as in item 1, differing in that the electrical charge engaging the target comprises a series of sequential impulses, in which the impulses having optimal parameters for inducing a motor reaction in the target in the form of a biological subject, alternate with impulses having optimal parameters for inducing a tonic/clonic reaction in the biological subject.

21. A weapon as in items 1 and 20, differing in that the electrical charge that hits the target comprises a series of sequential monopolar impulses, in which impulses with energy of 0.05-0.15 j and a spacing frequency of 150-300 Hz alternate with impulses with energy of 0.16-0.5 J and a spacing frequency of 5-30 Hz.

22. A weapon as in items 1 and 20, differing in that the electrical charge that strikes the target comprises continuous series of sequential monopolar impulses, in which packets of impulses with energy of 0.05-0.15 J and a spacing frequency of 150-300 Hz alternate with packets of impulses with energy of 0.16-0.5 j and a spacing frequency of 5-30 Hz, and the duration of the cycles is determined by a set-point device.

BRIEF DESCRIPTION OF DRAWINGS

The above and other features and advantages of the invention will become apparent upon reading the following description taken in conjunction with the accompanying drawings in which.

DETAILED DESCRIPTION OF THE PREFERRED EMBODIMENTS

Referring to FIGS. 1A through 1D, there is shown a clip 10 for holding, positioning and ejecting cartridges 12 for use with a remote electroshock weapon, not shown, to propel projectiles from the cartridges 12 for impact on a subject and delivery of an electrical charger thereto.

Figure 1B:
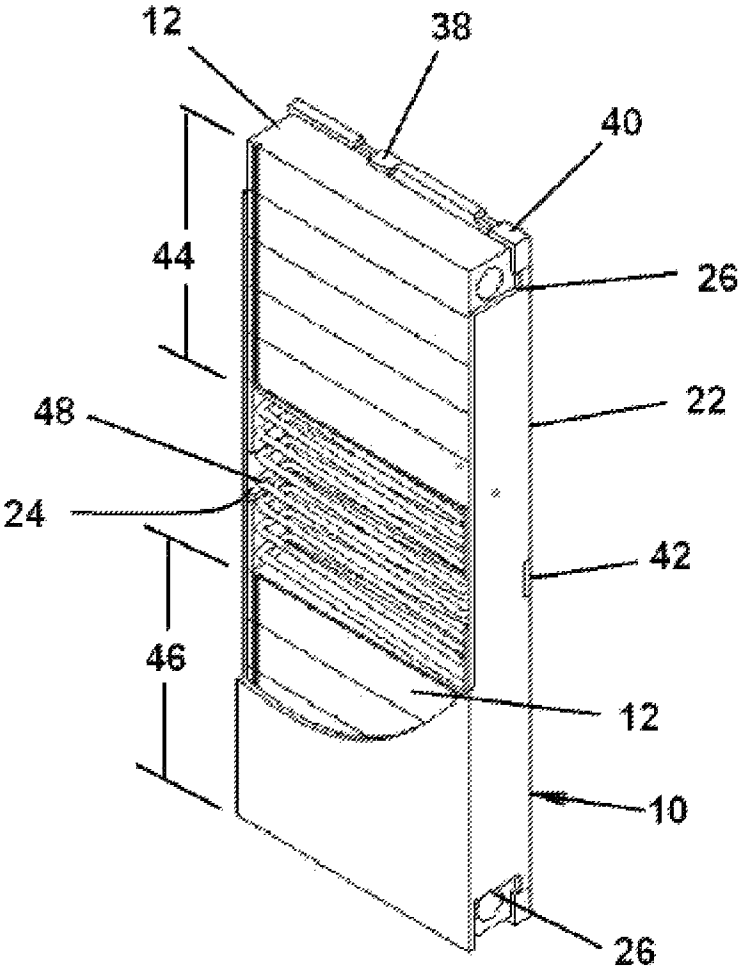
FIG. 1B is a partially sectioned rear perspective view of the cartridge clip of FIG. 1A.
Figure 1A:
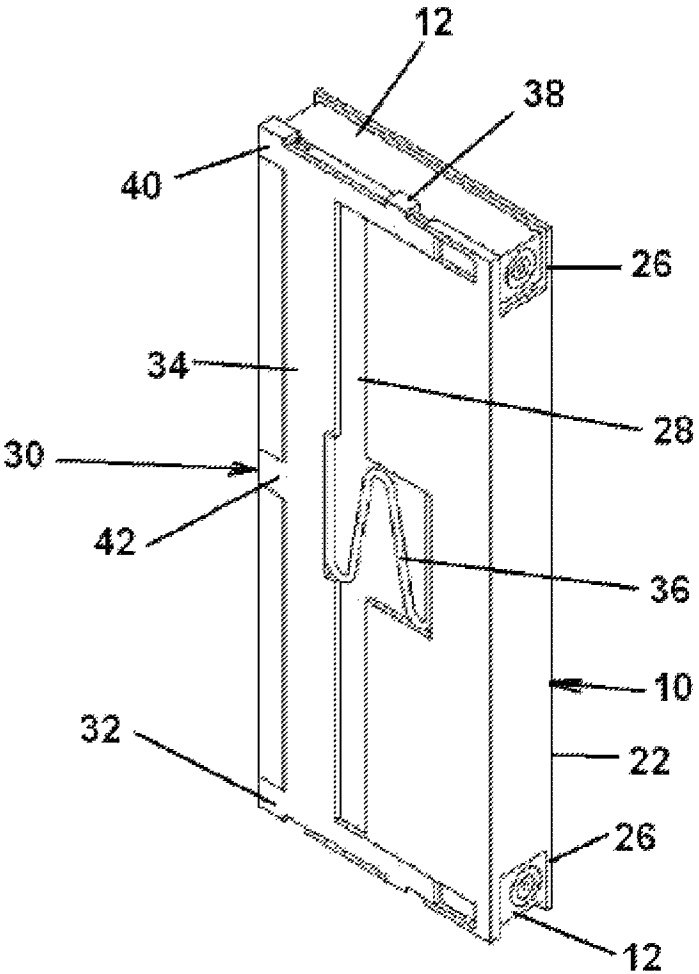
FIG. 1A is a front perspective view of a cartridge clip with the cartridges exiting in opposite directions according to an embodiment of the invention.
Figure 1C:
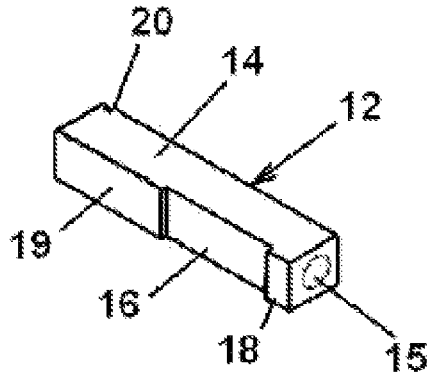
FIG. 1C is a perspective view of the cartridge for the clip of FIG. 1A.
Figure 1D:
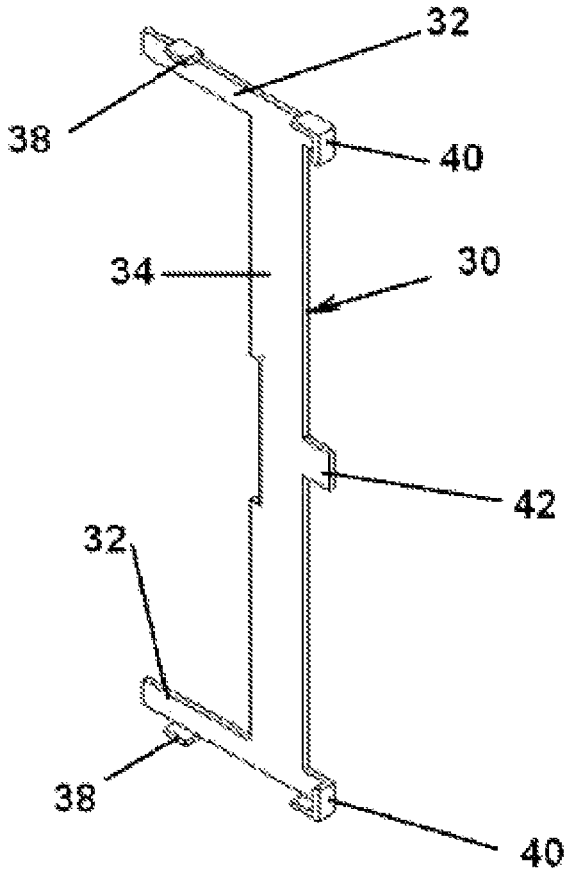
FIG. 1D is a perspective view of the pushrod for the cartridge clip of FIG. 1A.

The cartridge 12, as shown in FIG. 1C, includes an elongated housing 14, of rectangular cross section, having a longitudinal bore 15 internally carrying a projectile unit of the types disclosed in Russian Federation patent applications Nos. 200511259, 200511260 and 2005113206. The housing 14 has a vertical groove 16 on one side wall, adjacent the rear end of the cartridge, bounded by protrusions or projecting side ledges 18, 19. A narrow vertical slot 20 is formed on the opposed side wall adjacent the front end of the cartridge.

The clip 10 includes a support sleeve 22 having a center slot 24 extending vertically therethrough of a rectangular cross section slidably supporting the cartridges 12 and having laterally spaced side wall and longitudinally spaced end walls. The end walls include horizontally outwardly and vertically outwardly opening rectangular slots or grooves 26 providing openings corresponding with the cross sectional ends of the cartridge. The front side wall of the sleeve 22 includes an I-shaped recessed or open notch 28 slidably supporting a U-shaped pushrod 30 having spaced legs 32 slidably supported in corresponding horizontal slot portions of the notch 28, and a connecting body 34 disposed in a vertical slot portion of the notch 28 of greater width. A spring member 36 biases the pushrod to the normal position shown in FIG. 1A. The legs 32 of the pushrod have an inwardly projecting center tab 38 overlying the rear ledge of the cartridge housing and an inwardly projecting corner tab 40 overlying the rear corner of the ledge 18. An actuating tab 42 extends outwardly to the end wall of the sleeve through a slot in the side wall.

The cartridges are disposed and vertically aligned in the slot in an upper packet 44 and a lower packet 46. A spring assembly 48 is disposed between the packets and biases the cartridges to the ends of the sleeve whereat the end cartridges are retained by the tabs 38, 40.

Figure 2A:
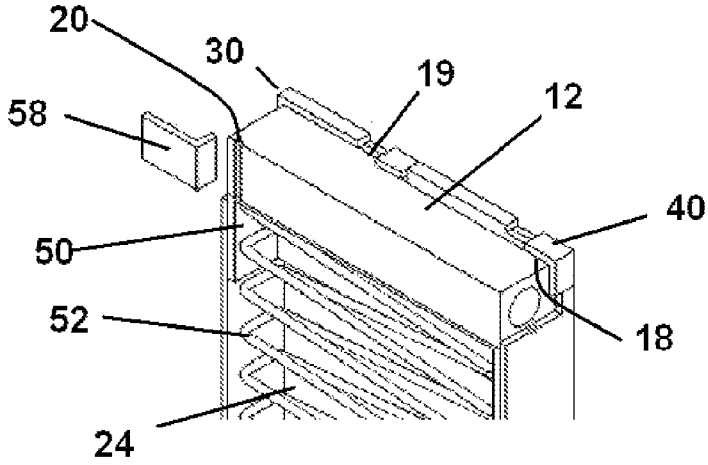
FIGS. 2A-2C are partial end views of the cartridge clip illustrating the cartridge in a delivery position, the firing position and the extraction position.
Figure 2B:
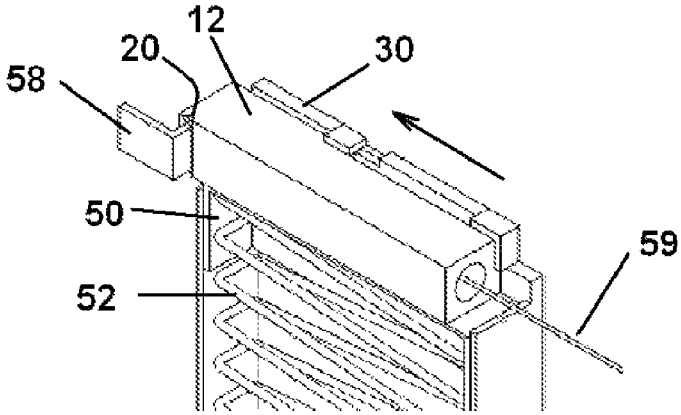
Figure 2C:
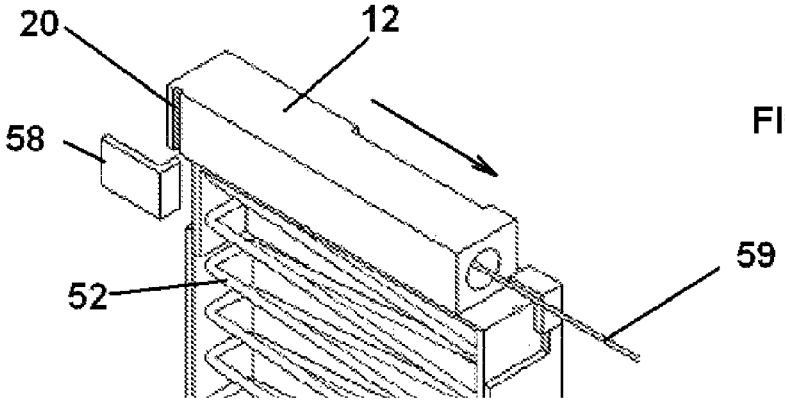

Referring to FIGS. 2A through 2C, the spring assembly 48 includes a pair of U-shaped feeding pushers or brackets 50 separated by a pleated feed spring 52. The cartridge packets 44, 46 are moved along the clip groove in opposite directions by the common feed spring 52 and a corresponding feeding pusher 50. The pushrod 30 and the spring assembly 48 are covered by a cap member, not shown, in assembly. The cartridge packets are loaded into the clip from the appropriate side of the clip, by sequentially pushing them back into the groove. The loaded clip is inserted into the weapon and secured with a corresponding mechanism. The design of the clip securing mechanism could be similar to that used in a firearm with a detachable clip. When used in a weapon with a fixed magazine, center slot 24 can be made in the form of a chamber within the weapon's housing. The cartridge packets are loaded into the weapon's fixed magazine similarly to the loading of cartridges into a detachable clip. The rendition of the weapon with detachable clip is preferable, since it allows for rapid reloading.

FIGS. 2A through 2C illustrate respectively the delivery position, the firing position and the ejection or extraction position of the cartridge. FIG. 2A shows the starting delivery position of the cartridge 12 in the clip center slot 24 before firing as also illustrated in FIGS. 1A and 1B. Thereat, the pushrod tabs 38, 40 are engaged with the corresponding surfaces 18, 19 on the cartridge, restraining the cartridge from being ejected from the clip by the force of the spring 52. When the firing element of the weapon is squeezed, the pushrod 30 moves the cartridge 12 as indicated by the arrow into the firing position shown in FIG. 2B. At the firing position, a L-shaped catch 58, situated in the weapon's housing, engages the slot 20 on the cartridge 12. The catch 58 can at once fulfill the role of current-carrying contact, through which voltage is fed to the triggering element of the launch power source. At the end of the pushrod's travel, when the cartridge is in firing position, the launch power source is triggered and a shot occurs launching the projectile unit and associated wire 59. When the firing element of the weapon is released as shown in FIG. 2C, the pushrod 30 is returned in the direction of the arrow to the normal position by the spring 36 removing the corner tab 40 from the cartridge surface 18 and aligning the middle tab 38 with the cartridge groove 16. Upon ejection, the next cartridge in the packet is shifted by the clip spring 48 to the delivery position and retained thereat by the pushrod tabs. The variation described here for delivering and extracting the cartridge represents the particular case when the cartridge is moved into firing position in the lengthwise direction, opposite to that of the shot. In the other variations, the cartridge can be moved into firing position either in the lengthwise direction or perpendicular to the direction of the shot. In addition, the configuration of the pushrod and its protrusions, as well as that of the cartridge and its protrusions, that ensures engagement of the pushrod and cartridge upon firing and their disengagement when extracting the spent cartridge, can vary greatly.

Figure 3:
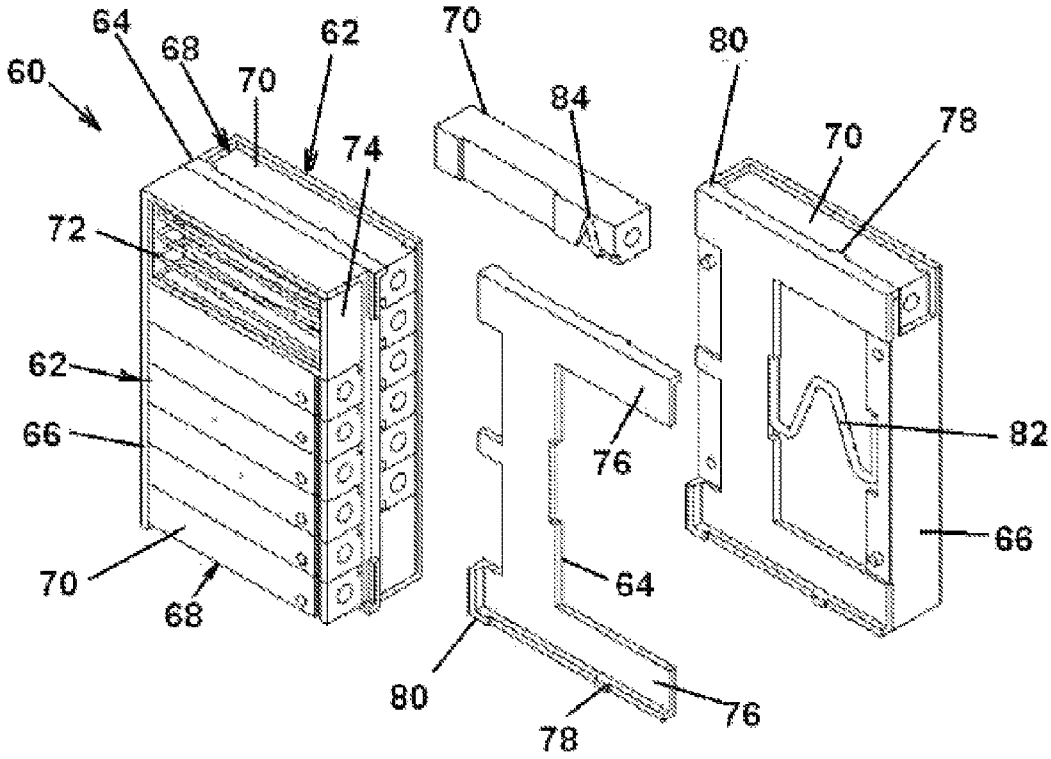
FIG. 3 is a partially sectioned perspective view of a cartridge clip in accordance with another embodiment.

Another embodiment of the clip is shown in FIG. 3. Therein, the clip 60 includes a pair of juxtaposed clip units 62 having a pushrod 64 therebetween. Each clip unit 62 has a housing sleeve 66 with a vertical through slot. Each sleeve 66 includes a cartridge packet 68 carrying cartridges 70. Each packet 68 is biased by a feed spring 72 acting on a feeding bracket or pusher 74 to bias the cartridges to a delivery positions in opposed directions. At the feed delivery positions, the cartridges are aligned with end notches in the clip units as described in the foregoing embodiment.

The arms 76 of the pushrod 64 have middle tabs 78 and end tabs 80 extending in opposed lateral directions. One set of tabs engage the lower cartridge in one packet, and the other set of tabs engage the upper cartridge in the other packet. For cartridges of the type described above, the cartridges are moved from the feed position to the firing position and to the ejection position as described above as governed by movement of the trigger actuated pushrod. The cartridge packets accordingly move in opposing directions. The pushrod 64 has a return spring 82 for biasing the pushrod to the illustrated normal position. The clip units and pushrods are enclosed in assembly by a suitable casing, not shown.

The cartridge 70 is the same as previously described but is additionally adapted for use with a pneumatic launch power source. A locking lever 86 is situated in the recess that is built into the side surface of the cartridge. The firing of the cartridge with pneumatic launch power source is triggered upon the mechanical interaction of the lever 84 and a corresponding protrusion located on the weapon's housing, when the cartridge advances into the firing position.

Figure 4:
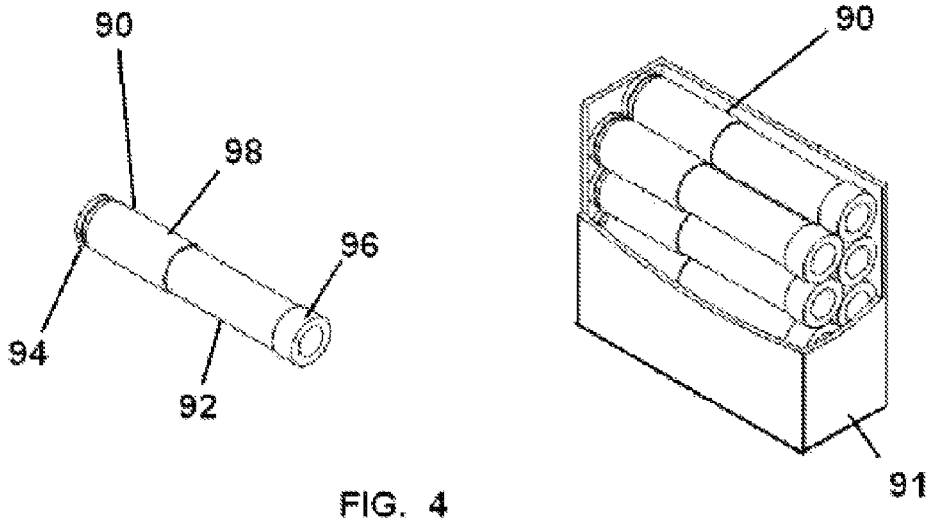
FIG. 4 is a partial perspective view of another embodiment of the cartridge and clip.

Another embodiment is shown in FIG. 4 using a cylindrically-shaped variation of cartridge 90 carried in a clip 91. In this variation of the cartridge, the function of the protrusions that interact with the pushrod's protrusions is played by cylindrical surfaces with a large radius. The middle annular groove 92 corresponds to groove 16 of the cartridge 12, the end annular groove 94 corresponds to groove 20, and define annular protruding surfaces 96, 98 that interact with tab surfaces on the pushrod to move the cartridge between the loading, firing and ejecting positions as described above. For purposes of increasing the capacity of the detachable clip or fixed magazine, the cylindrically-shaped cartridges can be positioned in the clip or the magazine in a staggered (multi-row) arrangement. The cylindrically-shaped cartridges can also be used in other types of magazines—for instance, circular or worm type magazines.

Figure 5:
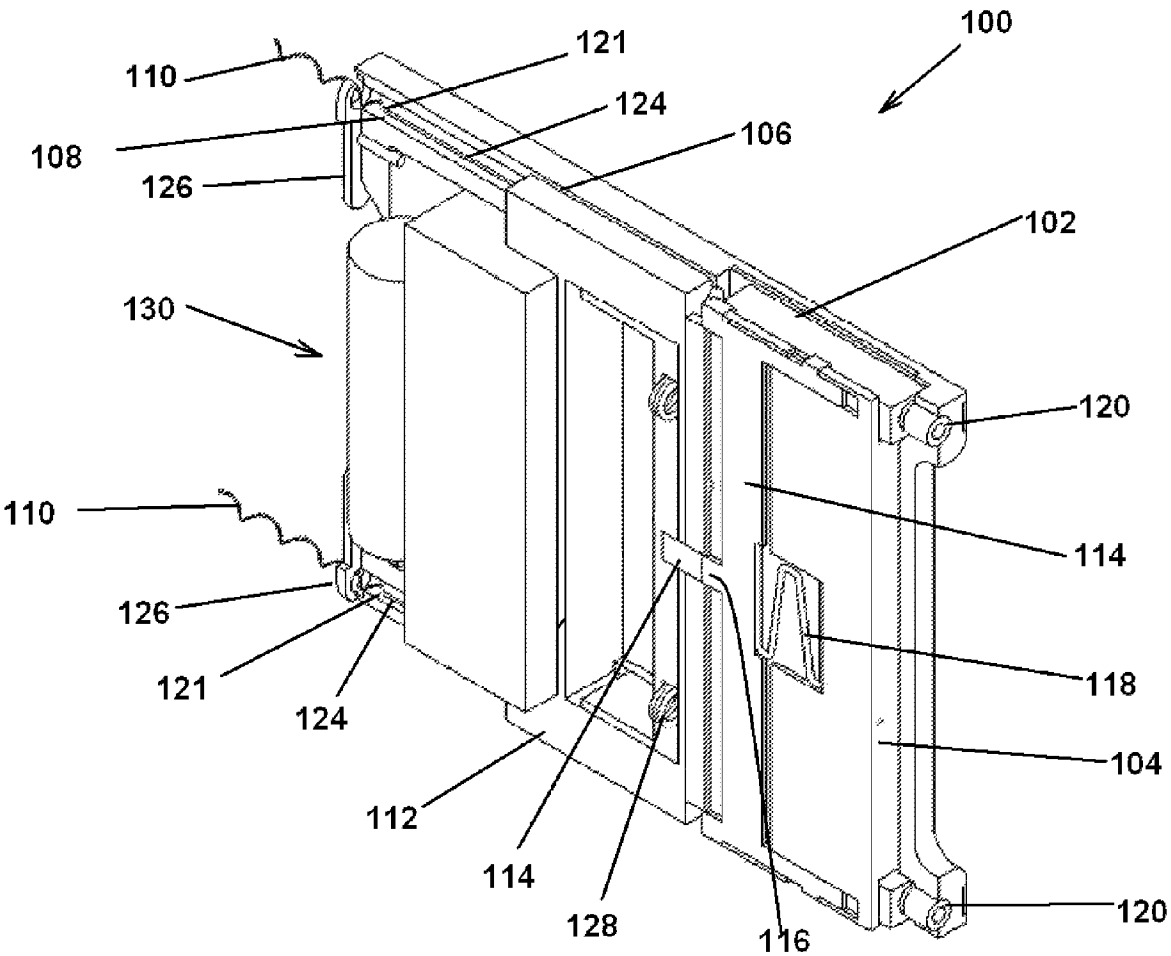
FIG. 5 is a perspective view of weapon based on the cartridge and clip of FIGS. 1A and 1B.

Referring to FIG. 5, there is shown a weapon 100 for a unitary cartridge 102 having an electrically an electrically-triggered pyrotechnical launch power source. The weapon 100 is provided with a cartridge clip 104 of the type illustrated in FIGS. 1 and 2. Longitudinal slits 106 are provided in the top and bottom of the weapon 100 registering with a guide channel 108 through which the projectile unit and attached wire 110 are propelled by the power source. The cartridge and the clip are illustrated in the firing position. When the trigger is released, the spent cartridge is ejected from the clip as described with reference to FIG. 2 and wire 110 is ejected through the slit 106 after firing. This variant of the weapon uses a unitary cartridge, in which the launched projectile is made in the form of a rigid barrel section with the electric wire packed in its chamber and connected to the cartridge housing with a dielectric lead of a fixed length. A pyrotechnic charge, triggered by a fusehead, is used as the launch power source. A detailed description of the unitary cartridge is given in Russian Federation patent application No. 2005113206.

The weapon includes a sliding trigger 112 having a trigger pushrod 114 that actuates the actuating tab 116 of the clip 104 to the illustrated firing position against the biasing of the return spring 118, which in turn moves the two outer cartridges to the illustrated firing position. At the end of the trigger movement, when the cartridges are in the firing position, a triggering circuit for the launch power sources is closed and a shot is fired, in which the two cartridges go off simultaneously. The current that activates the launch power sources is fed through current-carrying contacts 121, located in the weapon's housing, that engage the base electrode (FIG. 1C). The metal catch 58 (FIG. 2B), engages the cartridge slots 20 to complete the firing circuit. When trigger release 112 is pressed, simultaneous to the closing of the circuit triggering the launch sources, there occurs a parallel commutation of the high-voltage generator's circuit, and high voltage is fed to the weapon's output electrodes 126. Upon firing, the launched projectiles with the electric wire packed in the projectile chamber move along the guide channels of the weapon's dielectric housing. The length of dielectric lead connecting electric wire 110 to cartridge 102, is fixed so that the part of the weapon held by the shooter's hand is safely isolated from the elements that are fed with voltage from the high-voltage generator. After firing, the attachment point 120 that secures the projectile electric wire 110 to dielectric lead 124 is close to electrodes 126, which are situated at the end of the guide channels on the weapon's muzzle end face. Thus dielectric lead 124 plays the role of insulation, separating electrodes 126, through which high voltage is fed to the electric wires 110, from that part of the weapon that is held in the shooter's hand.

In order for the attachment point 120 that secures dielectric lead 124 to electric wire 110 to always be near the electrodes 126, the dielectric lead is made of material less elastic than the electric wire that is packed in the launch projectile. For example, the dielectric lead can be made of caprone thread, while flexible brass wire is used for the electric wire. In this case, when the dielectric lead and the wire connected to it are opened up from the projectile chamber, the dielectric lead will be opened to its full fixed length, since during the flight process and after the projectile is attached to the target, the elastic brass lead that is packed into the projectile behaves like an elastic spring, pulling out the caprone thread in a straight line.

Upon being released, the trigger 112 returns to the starting position under the biasing of return spring 128, and the pushrod 114 returns to its starting position under the biasing of its return springs 118 and the spent cartridges are extracted. The electric wire and the dielectric lead that is attached to the cartridge exit from the guide channel through a lengthwise slit 106 made in the guide channel 108. The electrodes 126 also have an exit slit for the wires. There is an electrical unit 130 situated in the weapon's housing, which includes a voltage converter and the circuit of the high-voltage generator. The power source can be located in the electrical unit 130 or in the weapon's handle. The high-voltage portion of the weapon contains a transformer, the high-voltage outlets of which are connected to electrodes 126. A second shot can be produced immediately after the spent cartridges are extracted, by pressing the trigger a second time. The number of consecutive shots that the user can produce without reloading the weapon is determined by the capacity of the clip (magazine).

Figure 6:
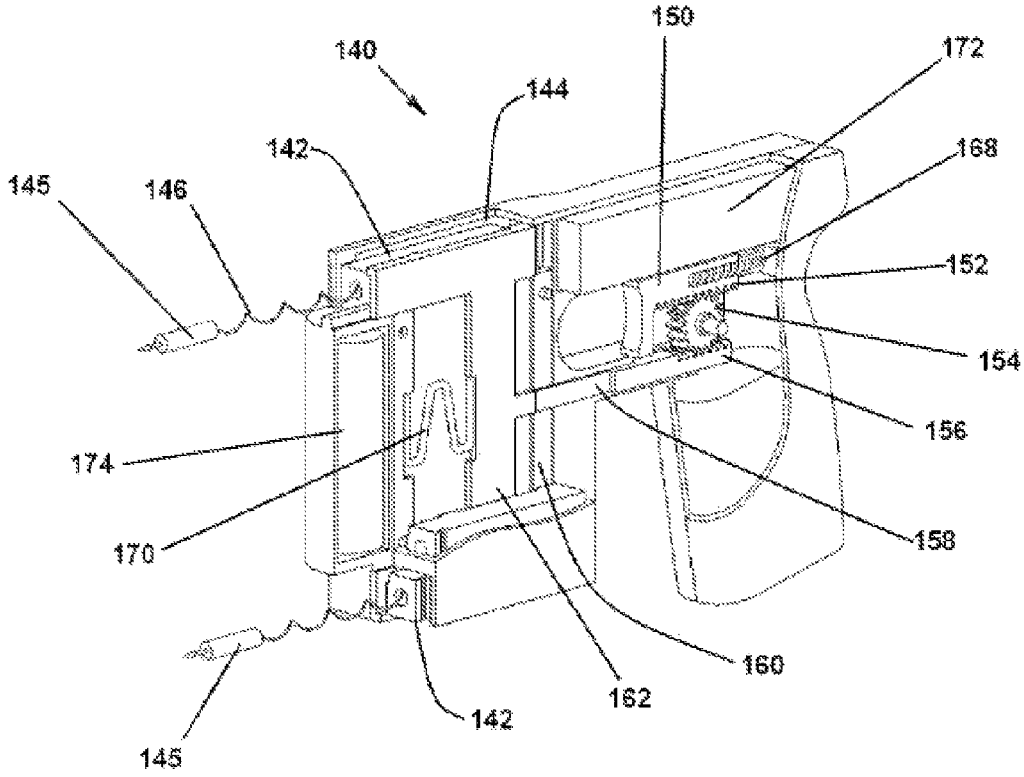
FIG. 6 is a view of weapon based on unitary cartridge and clip depicted in FIG. 3.

FIG. 6 shows a variation of the weapon 140 based on a unitary cartridge 142 with a mechanically triggered pneumatic launch power source and having a clip 144 for the cartridges as depicted in FIG. 3 for launching projectile unit 145 carrying a conductive wire 146 for delivering an electrical current to an impacted target. This variation of the weapon uses a unitary cartridge with a pneumatic launch power source, which is triggered by the mechanical interaction of a locking lever 84 (FIG. 3) and a corresponding protrusion situated on the weapon's housing, when the cartridge moves into the firing position.

A detailed description of the unitary pneumatic cartridge is given in RF patent application No. 2005111259.

Upon being pressed, a sliding trigger release 150 having a rear gear rack 152 rotates a pinion 154 that engages a gear rack 156 to forwardly move a trigger pushrod 158. The trigger pushrod 158 enters a corresponding slot in the clip housing 160 and displaces the clip pushrod 162, which simultaneously moves the two outer cartridges 142 from each packet along the corresponding clip groove into the firing position as described above. When the cartridges have been moved into the firing position, the cartridge's locking lever 84 is shifted by protrusion, located on the weapon's housing, and a shot is fired, in which the two cartridges go off simultaneously. When the trigger release is depressed, simultaneous to the firing of the shot there occurs a parallel commutation of the high-voltage generator's circuit. High voltage is fed to the outer cartridge in each of the packets, situated in different clip grooves. The voltage feed takes place in the spot where the electrical wire is fastened to the cartridge housing, or to the special cartridge outlet connected to the electric wire if the cartridge housing is made of non-conductive material. If the cartridge housing is metallic, the high voltage can be fed directly to the cartridge housing. The cartridges situated in different grooves, are fed with high voltage of varying polarity. The cartridge packets are isolated from one another by the walls of the grooves, which are made of dielectric material with high breakdown strength, e.g., polyethylene, and a wall thickness is chosen that will reliably preclude the possibility of an electrical breakdown due to the generator's voltage.

Upon being released, trigger release 150 returns to its starting position by the action of return spring 168, rearwardly moving the trigger pushrod 156 through pinion 154. When trigger pushrod 156 is moved to its starting position, the clip pushrod 162 returns to its starting position by the action of return spring 170, and the spent cartridges are extracted along with the electric wire. In this variant of the weapon, the electrical unit 172, which includes a voltage converter and the circuit of the high-voltage generator, is situated in a compartment above the safety release, while the power source 174 is located in the high-voltage front part of the weapon.

In the variants of the weapon shown in FIGS. 5 and 6, the cartridges are fed into the firing position, and the spent cartridges extracted, by the shooter's own muscle power. In other variants of the weapon, an electromechanical drive may be used for feeding and extraction. In this instance, when the trigger element is pressed there occurs a commutation of the control circuit of the electromechanical drive, which displaces pushrods of the clips. By way of example, the electromechanical drive can be based on an electromagnet, electric motor, or actuator. When using an electromechanical drive, the weapon can be made semiautomatic or automatic. In the semiautomatic or automatic versions, the electromechanical drive control circuit includes a delayer. When the latter goes into effect, after the cartridges are moved into the firing position, pushrod is held in the firing position for the time needed to transmit the electric impact to the subject. In the semiautomatic version, when the trigger element is pressed there occurs a commutation of the control circuit of the mechanical drive, which displaces the pushrod that feeds the cartridges into the firing position. After the delayer goes into effect, the mechanical drive returns the pushrod to the starting position and the spent cartridges are extracted. In the semiautomatic version, when the trigger element is pressed one cycle is completed, at which the cartridges are advanced to the firing position and held in that position during the time it takes to transmit the impact to the subject, and the spent cartridges are extracted. In order to repeat the cycles in the semiautomatic version, the trigger element must be pressed again. In the weapon's automatic version, when the trigger element is pressed the cycles are repeated automatically as long as the trigger element remains depressed. In other versions of the weapon, the cartridges can be advanced and subsequently extracted by accumulating a portion of the energy from the previous firing, or by using a supplemental pyrotechnic charge located in the cartridge. In this case the extraction, resulting from a release of the energy accumulated from the previous firing or from the action of the supplemental pyrotechnic charge, also takes place with a time delay needed to transmit the impact to the subject. The delayer can be mechanical or electric.

In the variants of the weapon shown in FIGS. 5 and 6, with the cartridges situated in a clip with one or two grooves, the distance between the cartridges when in the firing position is maximal and is determined by the selection of acceptable dimensions for the weapon.

Figure 7:
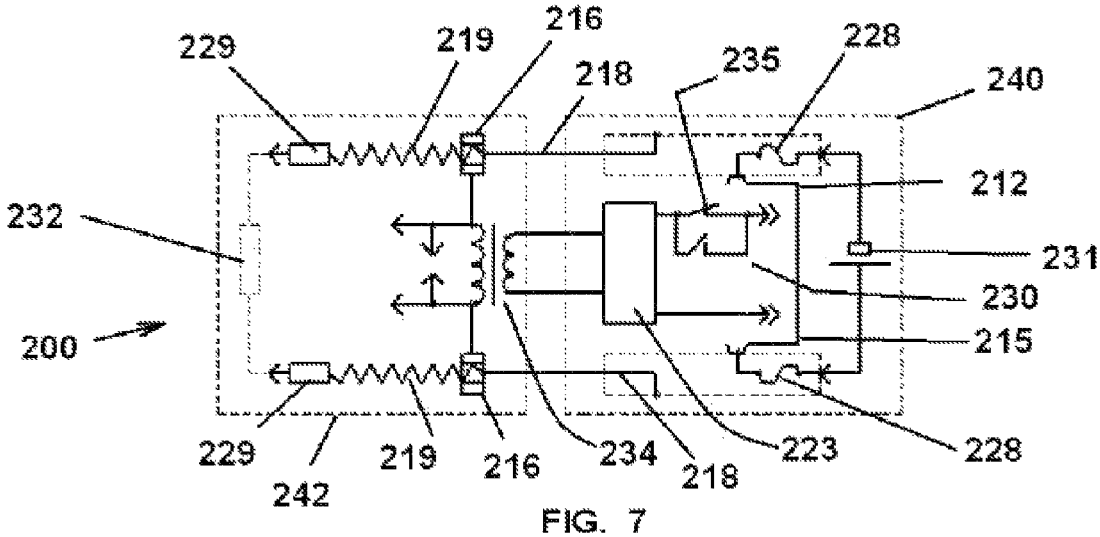
FIG. 7 is an electrical diagram of the weapon depicted in FIG. 5, illustrating the device's action when used in remote mode.
Figure 8:
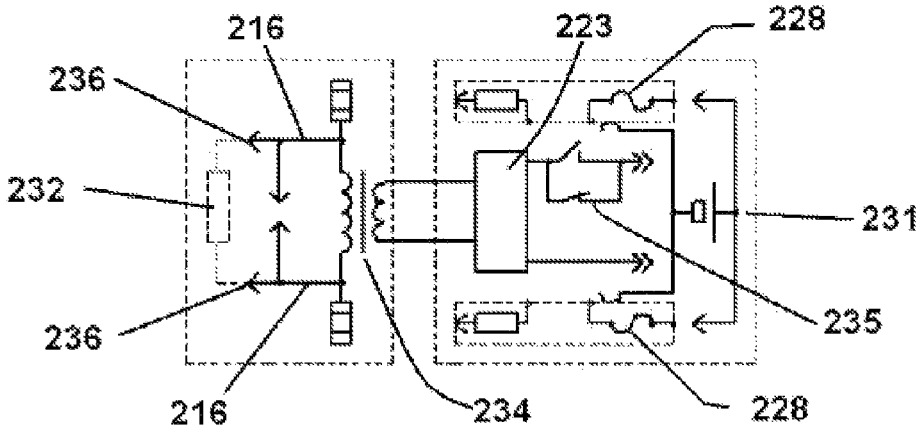
FIG. 8 is an electrical diagram of weapon depicted in FIG. 5, illustrating the device's action when used in contact mode.

FIG. 7 shows the weapon's circuit diagram for the control system 200 of the weapon of FIG. 5, illustrating the device's operation when used in remote mode wherein the projectile unit impacts the subject. When the trigger element is pressed, the cartridges are advanced into the firing position and voltage is fed from power supply source 231 through current-carrying contacts 215 and contacts 212, which are also the catches that hold the cartridge in the firing position, to the triggering elements of the pyrotechnic launch power source in the form of incandescent elements 228. In the variant shown in FIG. 7, the elements 228 of the two cartridges are switched on in series with power supply source 231. In another variant as shown in FIG. 8, the elements 228 can be switched on in parallel with the power supply source 231. When current goes through glow elements 228, the pyrotechnic charge of the cartridge is triggered and projectiles 229, along with the electric wire 219 that is packed into the projectile chamber, are launched toward the target. Simultaneous to the closing of the fire triggering circuit, there occurs a commutation of the key 230, which feeds voltage from the power supply outlets 231 to the electrical unit 223. When voltage is fed from the power supply source to the electrical unit 223, the high-voltage generator's circuit turns on and high voltage is fed from the terminals of transformer 234 to the electrodes 216. When projectiles 229 hit the target, high voltage is delivered from electrodes 216 through electric wires 219 to the subject's body, depicted in FIG. 7 in the form of equivalent resistance 232, and the electric shock current begins to run through the subject. Part 240 of the weapon, the elements of which are under low voltage and are securely isolated from the shooter's weapon hand, is isolated from part 242, in which the high voltage is delivered, by the dielectric leads 218 of the cartridges, the launched projectiles of which travel in the weapon's dielectric guide channels.

Referring to FIG. 8, when the weapon is used in the contact mode, i.e. by direct manual impact of the front of the weapon against the subject, independent switch 235, which feeds power from the terminal of power supply source 231 to electrical unit 223, is closed. When voltage is fed from the power source to the electrical unit 223, the high-voltage generator's circuit turns on and high voltage is fed from the lead terminals of transformer 224 to the current-carrying electrodes 216. The electrodes 216 are electrically connected to corresponding contact electrodes 236, through which the shock current is delivered to the subject, depicted in the form of equivalent resistance 232. When the weapon is used in the contact mode, high voltage is fed to contact electrodes 236 without moving the cartridges, and consequently without firing a shot, which allows the shooter to select the desired mode of use (contact or remote). The independent switch 235 can be made in the form of a separate button or switch that is triggered with the same hand in which the shooter holds the weapon, for example, the thumb. The electrical unit 223 and launch power sources can be triggered, either from a common power supply source or from separate sources.

Figure 9:
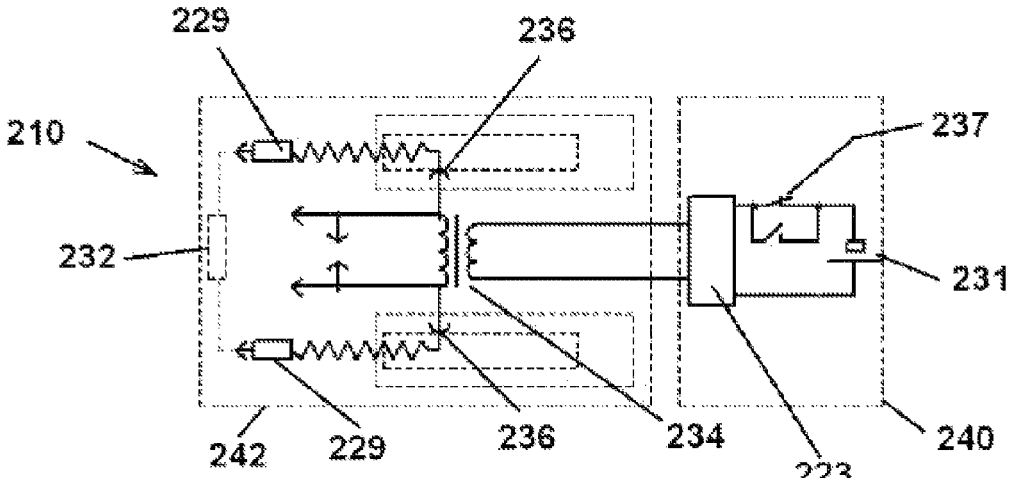
FIG. 9 is an electrical diagram of weapon depicted in FIG. 6, illustrating the device's operation when used in remote mode.

FIG. 9 shows the circuit diagram for the control system 210 of the weapon of FIG. 6 illustrating the device's operation when used in remote mode. When the trigger element is pressed, the cartridges that are situated in the two mutually isolated grooves of the clip are fed into the firing position, upon which they are mechanically triggered. Simultaneous to the firing trigger, there occurs a commutation of key 235, which feeds voltage from the power supply source 231 to the electrical unit 223. When voltage is fed from the power supply source to electrical unit, the high-voltage generator's circuit turns on and high voltage is fed from the terminals of transformer 234 to the electric wires 219. Part 240 of the weapon, the elements of which are under low voltage and are securely isolated from the shooter's weapon hand, is isolated from part 242, in which the high voltage is delivered, by means of the spatial separation of the parts 240 and 242 within the weapon's housing, which is made of insulating material. When the weapon is used in the contact mode, independent switch 235 undergoes commutation without moving the cartridges into the firing position, and voltage from the high-voltage generator is fed to the weapon's contact electrodes 236.

Figure 10:
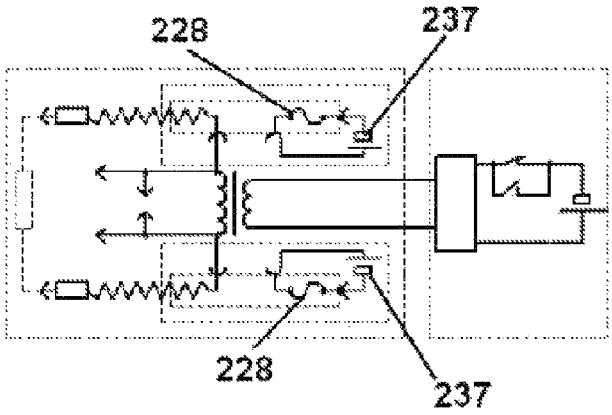
FIG. 10 is a variation of electrical diagram of weapon, with autonomous activation of heated element of pyrotechnical launch power source.

In another variant of the weapon as shown in FIG. 10, which employs cartridges with a pyrotechnic launch power source, one can use autonomous power supply sources 237 to trigger the glow elements 228. Therein, the cartridges are placed in the two mutually isolated grooves of the clip. Each of the two cartridges is triggered from its respective independent power supply source 237 when the cartridges are advanced into the firing position. The independent power supply sources 237 with their respective current-carrying contacts can be situated in the clip or in the weapon's housing.

Figure 11:
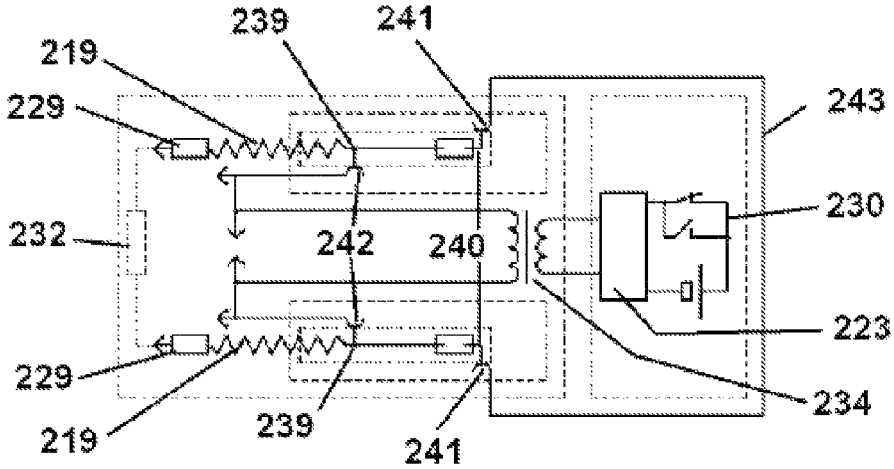
FIG. 11 is an electrical diagram of a weapon, with launch power source triggered by an electric spark from a high-voltage generator, illustrating the remote mode.

FIG. 11 shows the circuit diagram of the weapon with the launch power source triggered by an electric spark from the high-voltage generator, in remote mode. This variant of the weapon can employ the unitary cartridges described in RF patent application No. 2005111260. The cartridges 200 are situated in the two mutually isolated grooves of the clip. The cartridge housing is made of insulating material and has a launch power source 238 that is triggered by electric spark. When the trigger element is pressed, the outer or upper cartridges in each of the clip packets are moved into the firing position, and the terminals 239 and 240 of the launch power source (38) of each of the cartridges are connected with current-carrying contacts 241 and 242, respectively. Simultaneous to the closing of contacts and there occurs a commutation of key 230, which supplies power to the electrical unit 223 that contains the voltage converter and the circuit of the high-voltage generator. High voltage is fed from the terminals of transformer 224 to the current-carrying contacts 242, which close a circuit with the contacts 240 of the cartridges that have been moved into firing position. Contacts 241 are connected to one another by current-carrying jumper wire 243. When high voltage of different polarities is fed to cartridge contacts 240, an electrical charge passes through the launch power sources 238 and firing occurs, upon which the two cartridges go off. After the cartridges' launch power sources 238 go off, the trigger circuit is disrupted, upon which the charge stops flowing through the jumper wire 243 and is transmitted through the subject's body resistance 232 along wires 219, after the projectiles 229 have attached to the subject. The disruption of the trigger circuit after the launch power sources go off can be achieved, for instance, by forming an insulating space in the cartridge chamber after the shot, filled with nonconductive products of combustion from the pyrotechnical compound, or by using the projectile's conductive body as a triggering conductive jumper wire that is removed from the cartridge after firing.

Figure 12:
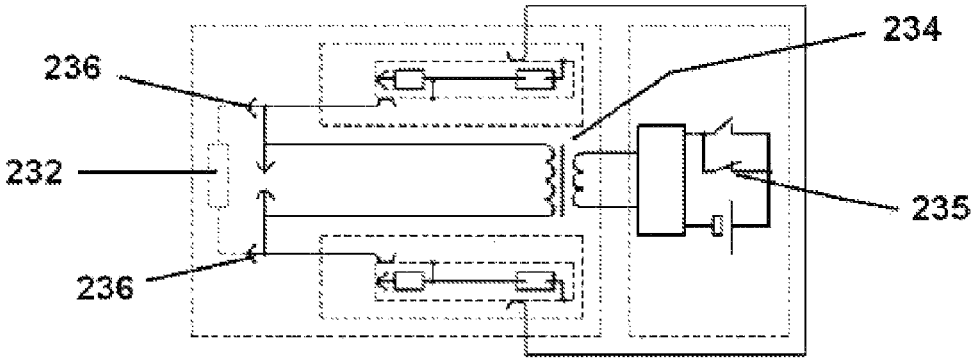
FIG. 12 is an electrical diagram of weapon of FIG. 11 in the contact mode.

The cartridges located in the clip grooves are insulated from the high-voltage circuit by the spatial separation of conductive contacts 241 and 242 from the contacts 239 and 240 of the cartridges located in the clip grooves, at a distance that precludes the transmission of a charge through the cartridge power sources. Referring to FIG. 12, when the weapon is used in the contact mode with the cartridges in the clip grooves, high voltage is fed from the terminals of transformer 234 to the weapon's contact electrodes 236, with independent switch 235 closed. The latter feeds power to the electrical unit 223 that includes a voltage converter and the circuit of the high-voltage generator. At the same time, since conductive contacts 241 and 242 are isolated from terminals 239 and 240 of the launch power source of the cartridges located in the clip grooves, no shot is triggered, and when electrodes 236 are closed on the subject the shock current passes through the subject's body resistance 32.

In the "Advanced Taser M-26", a device for transmitting shock current through a subject, an insulated wire is used to prevent the electric charge from shunting if the wires cross or touch. The crossing of wires after firing is brought about by the design of the "Advanced Taser M-26"'s cartridge. The wire in the device's cartridge is stowed in a separate side chamber and is kept from freely exiting the chamber by a retainer cap. The projectile is located in a separate launch channel and is bound to the wire that is stowed in the cartridge's side chamber. Upon firing, the retainer cap holding back the wire in the cartridge's side chamber is removed, and the accelerated projectile draw out the wire, which freely opens out of the chamber under the action of an impulse that is transmitted to the wire by the projectile that is pulling it. Since the wire is situated in the cartridge's side chamber, offset relative to the center line of the launched projectile, the center of mass of the launched wire is not arranged coaxially to the center of gravity of the projectile. As a result of this, the direction of the impulse acquired by the wire's center of gravity under the action of the projectile pulling it does not coincide with the direction of the projectile's impulse. Thus the wire, upon being opened up from the cartridge's side chamber, makes significant lateral shifts. With a fairly small initial distance between the chambers and the packed wires (20-25 mm), the presence of significant lateral shifts by the wire leads to a crossing or touching of the wires during the projectiles' flight toward the target.

In the unitary cartridges used in the multi-firing remote weapon being applied for here, as distinguished from the cartridge of the "Advanced Taser M-26", the launched wire and projectile are arranged in a common chamber. In addition, the center of gravity of the wire and the projectile is on the same axis. The coaxial arrangement of the center of gravity of the projectile and the wire makes it possible to substantially reduce the wires' lateral movements as they are opened. The negligible lateral movements by the wires as they are opened, as well as the large initial separation between the launched wires of the two unitary cartridges, make it possible to eliminate the possibility of the wires crossing or touching, or of the charge passing between the wires, during the projectiles' flight toward the target.

Eliminating the possibility that the charge will pass between the wires during the projectiles' flight toward the target allows one to use a brief discharge of uninsulated wires to strike the subject, if the shock charge is transmitted through the subject during a period of time in which the launched electric wires do not cross one another. Since uninsulated wire possesses substantially less volume per unit of length than insulated wire, its use in the weapon's unitary cartridges makes it possible to substantially reduce the unitary cartridge's dimensions and increase clip capacity and firing range.

Figure 13:
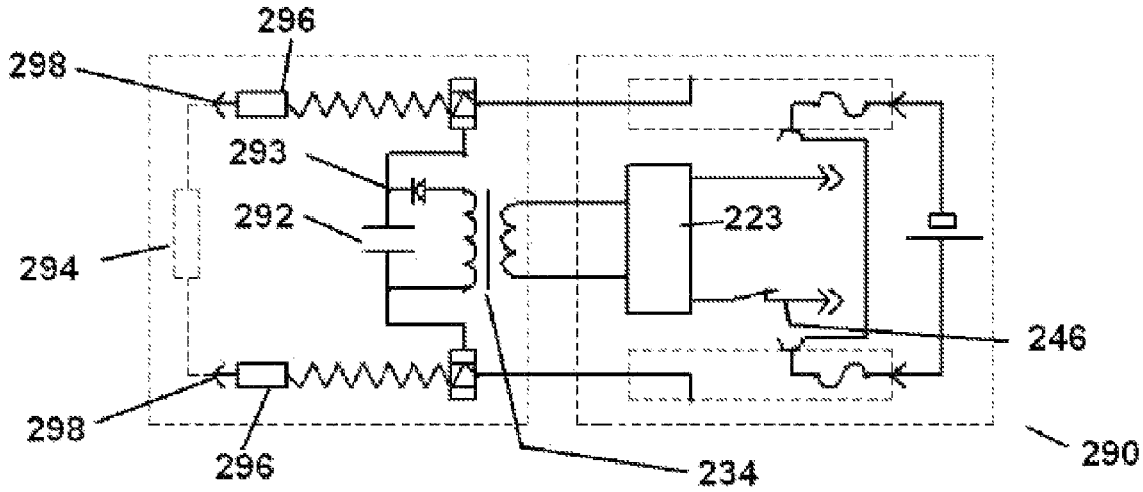
FIG. 13 is an electrical diagram of weapon using a brief, powerful discharge, synchronized with the moment at which the projectiles strike the target.

FIG. 13 shows the variant of the weapon depicted in FIG. 6, in which a brief, powerful charge is used to impact the subject. A high-voltage capacitor 292 is connected at the outlet of high-voltage transformer 234 through rectifier 293. Immediately before the weapon is deployed, the shooter moves switch 246 to the closed position. When key 246 is closed, voltage from the power supply is fed to the electric unit 223 and the high-voltage generator charges capacitor 292, the terminals of which are connected to current-carrying electrodes. When the cartridges are moved into the firing position, the circuit triggering the cartridges' launch power sources is closed, and the projectiles 298 and electric wire are launched toward the target. When the projectiles 298 hit the target, high-voltage capacitor 292 is closed through current-carrying electrodes and along the electric wires to the subject's body resistance 232, and the electric shock current passes through the subject's body. While the spent cartridges are being extracted, capacitor 292 is recharging, and by the time each subsequent shot is fired, capacitor 292 is freshly charged. Thus a powerful charge from the high-voltage capacitor is transmitted through the subject's body with each shot.

The ability to shock a subject with a single, sufficiently powerful capacitor charge is confirmed by experiments conducted by numerous researchers in the $18^{th}$ century, in particular by Abbot Nole. Modern high-voltage capacitors, which offer the ability to store a substantial amount of energy, enough to shock a subject, are of dimensions that are acceptable for use in a handheld weapon.

In the variant of the weapon of which a diagram is shown in FIG. 13, the moment when the shock charge from the capacitor passes through the subject's body is synchronized with the moment when the projectiles hit the target. In other variations of the weapon, in which the subject is struck during a span of time when the launched wires are not crossed, one can use a special circuit ensuring that the moment the momentary, powerful charge is generated and the moment the projectiles hit the target are synchronized. For example, synchronization can be achieved by using a low-energy trigger impulse. As this impulse passes through the subject's body at the moment the projectiles hit the target, the circuit that generates the momentary, powerful charge is triggered, and the charge has time to pass through the subject's body before the conductors cross. In the variant shown in FIG. 13, the capacitor discharge occurs only with the closing of the discharge circuit connected to the electrodes. In order to remove the residual voltage from capacitor after deploying the weapon, the circuit may use a discharge resistor with high ohmic resistance.

The ability to additionally increase the effectiveness of an electric shock weapon consists in using a combined discharge in the form of a series of alternating sequential impulses of varied spacing frequency and varied physiological effect on the subject.

As described in U.S. Pat. No. 6,636,412, the effect of electric impulses with energy of 0.9-10 J, with an impulse spacing frequency of 2-40 Hz, induces involuntary, sustained contractions of the skeletal muscles, which leads to the subject being unable to control his muscles while the charge is passing through him. US Patent Publication No. 2004/0156163 describes how a similar physiological effect can exert impulses on a subject with energy on the order of 0.2 J and spacing frequency of 15-20 Hz. The physiological effect of these impulses consists in the electrical stimulation of the motor neurons (the nerve fibers of the muscle tissue) with the frequency of a smooth tetanus, where individual muscle contractions brought about by a single impulse merge into a unified, sustained muscle contraction. A drawback of this method of impact is that the stopping effect lasts only as long as the charge is being transmitted; after the charge stops, the subject's capacity for activity is renewed virtually immediately. Moreover, the stopping effect of the discharge that induces the involuntary, sustained contractions is dependent to a significant extent on the size of the spatial separation of the projectiles that are secured to the subject's body. If the projectiles are not sufficiently spread apart on the subject's body, the physiological effect of the discharge could be insufficient to effectively control the subject.

U.S. Pat. No. 4,709,700, "An Electroconvulsive Therapy Method", describes the parameters of impulses that induce a tonic-clonic attack similar to an epileptic fit. Electroconvulsive therapy (ECT) is widely used in psychiatry as a means of treating various psychiatric disorders. U.S. Pat. No. 4,709,700 describes the results of experiments in which it was established that a fit can be induced by a series of monopolar, right-angle impulses with energy of 0.02-0.1 j and a spacing frequency of 150-300 Hz. The ECT method is based on an over-stimulation of the brain's nerve cells as electrical current passes through it. In order to assess the capabilities of an electrical discharge to induce a fit, the concept of "convulsion threshold" is used, which is expressed in the minimum electric dose needed to induce a fit. When performing ECT, the electrodes to which voltage is fed are usually placed on the patient's head so that the current would pass through the brain. At the same time, the experimental results described in (1) show that under this method of electrical stimulation of the brain nerve cells, most of the current (90-95%) is shunted through the scalp and fails to reach the brain. U.S. Pat. No. 5,299,569 describes the method of electrical stimulation of the brain by means of electrically affecting the floating nerve (vagus). The foundation of the vagus is located in the region of the medulla, while its stem exits the cranial cavity and branches throughout the human body. Thus the electrical over-stimulation of the brain's nerve cells could be induced by an electrical discharge passing through the branches of the vagus located in a person's body, and a tonic-clonic fit could be induced in the person when the "convulsion threshold" is reached. The fit is characterized by an immediate loss of consciousness and the beginnings of tonic convulsions. The tonic convulsions last 10 to 20 seconds and then shift into clonic convulsions that encompass the entire body. The clonic convulsions last 20-30 seconds.

Thus a subject's physiological reaction to an electrical discharge can be provisionally divided into motor and tonic-clonic reactions. The motor reaction consists in involuntary, sustained contractions of the skeletal muscles while the charge is passing through the body, while the tonic-clonic reaction consists in the onset of a tonic-clonic fit, during which the subject is in a state of unconsciousness for a minimum of 30-50 seconds after the discharge is stopped.

The energy of an impulse capable of inducing a tonic-clonic reaction can be substantially less than that of an impulse inducing a motor reaction. Therefore, from the standpoint of minimizing the electric impact, the optimal application is that of a combined discharge, in which impulses of varied energy and spacing frequency alternate.

Thus the capacity to increase the effectiveness of an electric shock weapon using minimal electric power lies in the use of a combined charge, in which impulses having optimal parameters for inducing a motor reaction in the biological subject alternate with impulses having optimal parameters for inducing a tonic-clonic reaction in the biological subject. The effect produced on the subject by the electrical discharge that induces the tonic-clonic reaction can be effective even if there is only a small separation between the projectiles attached on the subject's body, provided the [body] area through which the current is transmitted encompasses an area through which the vagus runs. Since the vagus branches throughout the human body, there is a high probability of it falling within the area where the electric current passes, especially if the separation between the projectiles is fairly large.

As described in U.S. Pat. No. 4,709,700, monopolar impulses are optimal for inducing a tonic-clonic fit.

In the preferred variant of the weapon, the electric shock discharge consists of a series of monopolar impulses, in which impulses with energy of 0.05-0.15 J and a spacing frequency of 150-300 Hz alternate with impulses having energy of 0.16-0.5 j and a spacing frequency of 5-30 Hz.

In this embodiment of the weapon, the electric discharge striking the target consists of an uninterrupted series of sequential monopolar impulses, in which packets of impulses with energy of 0.05-0.15 J and a spacing frequency of 150-300 Hz intermit with packets of impulses having energy of 0.16-0.5 j and a spacing frequency of 5-30 Hz. The transmission time of the individual sequential packets is assigned by a switchgear.

Figure 14:
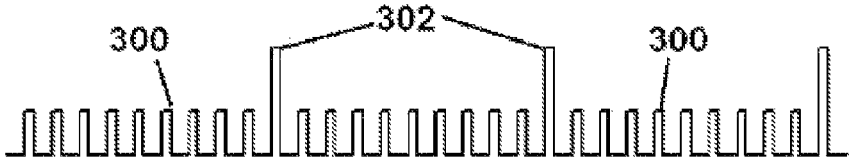
FIG. 14 is a series of sequential alternating impulses with varying energy and spacing frequency.

FIG. 14 shows the discharge, consisting of a series of monopolar impulses, in which impulses 300 that have lesser impulse energy and lower spacing frequency and induce the tonic-clonic reaction, alternate with impulses 302, which have greater energy and lower spacing frequency and induce the motor reaction.

Figure 15:
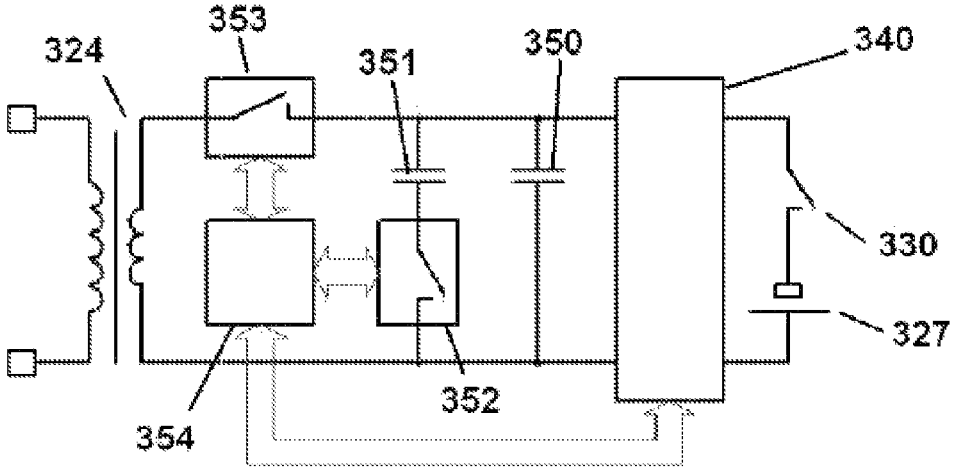
FIG. 15 is a diagram of the formation of a series of sequential alternating impulses with varied energy and spacing frequency.

FIG. 15 shows an embodiment of a control system 310 used to obtain a discharge from sequential alternating impulses with varying energy and spacing frequency. When key or switch 330 is closed, voltage from power source is fed to voltage converter 340. Voltage converter 340 charges storage capacitors 350 and 351. Capacitor 351 is connected to converter 340 through controlled switchgear 352, while capacitors 350 and 351 are switched onto the primary coil of high-voltage transformer 324 by controlled switchgear 353. An impulse 300 as shown in FIG. 15 is formed at the terminal of transformer 324, as the charged capacitor 350 is closed onto the transformer's primary coil by switchgear 353 with switchgear 352 open. Impulses 302 as shown in FIG. 15 are formed at the terminal of transformer 324 as charged capacitors 350 and 351, which are switched on in parallel, are closed onto the transformer's primary coil by switchgear 353, with switchgear 352 closed. Switchgears 352 and 353 are controlled by unit 354 which is based, for example, on a programmed processor, which controls switchgears 352 and 353 following a built-in algorithm for the sequencing, duration, and turn-on frequency of the switches.

CITED SOURCES

1. Convulsive Therapy No. 10, 1994: "Physical Properties and Quantification of the ECT Stimulus: 1. Basic Principles". Harold A. Sackeim, Ph.D., James Long, B. A., Bruce Luber, Ph.D., James R. Moeller, Ph.D., Isak Prohovnik, Ph.D., D. P. Devanand, M.D., Mitchell S. Nobler, M.D.

What is claimed:

1. A handheld multiple-charge weapon for remote impact on a target with an electric current, comprising:

a housing including a launch power supply, a power source, a voltage converter, and a high voltage generator and triggered by a firing element;

a clip on said housing carrying a plurality of unitary cartridges, each of said cartridges carrying an electrode for contact action on the target and delivering the electric current thereto, said cartridge including a wire connected to said electrode; said electrode being launched from each of at least two of said cartridges by said power source toward said target when said firing element is actuated in a firing position; means associated with said clip for moving said at least two cartridges to said firing position, and means operative after said firing element is actuated for extracting said cartridge and said wire from said clip; and means for connecting said wires of said actuated cartridges to said high voltage generator subsequent to said firing element being actuated after which the cycle of firing and extraction of spent cartridges can be repeated multiple times in manual, semiautomatic or automatic mode.

2. The weapon as recited in claim 1 including a shifting member moved from a first position to a second position wherein said cartridges are advanced to the firing position at said second position and disengaged from said cartridges in said first position.

3. The weapon as recited in claim 1 wherein said high voltage is delivered to electrodes designed for contact action on the target by means of an independent switch without advancing the cartridges to the firing position.

4. The weapon as recited in claim 1 wherein the launched projectiles travel in guide channels having a lengthwise slot for the electric wire to exit when said spent cartridges are extracted.

5. The weapon as recited in claim 4 wherein said guide channels are made of dielectric material.

6. The weapon as recited in claim 4 wherein said high voltage is fed to the launched electric wires at the end of said guide channels.

7. The weapon as recited in claim 1 wherein the power sources for launching the cartridges and triggered are synchronized with the moment when high voltage is fed to the electric wires.

8. The weapon as recited in claim 1 wherein said power sources for launching the cartridges are triggered mechanically or electrically.

9. The weapon as recited in claim 1 wherein said cartridges are spatially separated in said firing position.

10. The weapon as recited in claim 1 wherein said clip has a common groove and feed spring, and the cartridges exit the common groove in opposite directions.

11. The weapon as recited in claim 1 wherein said clip has two mutually isolated grooves with two feed springs, and said cartridges exit said grooves in opposite directions.

12. The weapon as recited in claim 1 wherein said cartridges in said clip are isolated from the high-voltage discharge circuit.

13. The weapon as recited in claim 1 wherein said clip has a multi-row cartridge arrangement.

14. The weapon as recited in claim 1 wherein said cartridges are manually advanced into the firing position and/or extracted at the extraction position.

15. The weapon as recited in claim 1 wherein said cartridges are advanced into said firing position and/or extracted at said extraction position by an electromechanical drive.

16. The weapon as recited in claim 1 wherein said cartridges are advanced into the firing position and/or extracted by retaining part of the energy from the preceding shot, or the energy of an additional pyrotechnic charge located in the cartridge.

17. The weapon as recited in claim 1 wherein the target is hit by a powerful, momentary electrical charge that is transmitted to the target over a span of time during which no contact or electrical disruption occurs between the launched wires.

18. The weapon as recited in claim 17 wherein the moment when the powerful, momentary electrical charge is transmitted through the target is synchronized with the moment the projectiles hit the target.

19. The weapon as recited in claim 18 wherein a D/C capacitor is used as the end element of the high-voltage generator.

20. The weapon as recited in claim 1 wherein the electrical charge engaging the target comprises a series of sequential impulses, in which the impulses having optimal parameters for inducing a motor reaction in the target in the form of a biological subject, alternate with impulses having optimal parameters for inducing a tonic/clonic reaction in the biological subject.

21. The weapon as recited in claim 20 wherein the electrical charge that hits the target comprises a series of sequential monopolar impulses, in which impulses with energy of 0.05-0.15 J and a spacing frequency of 150-300 Hz alternate with impulses with energy of 0.16-0.5 j and a spacing frequency of 5-30 Hz.

22. The weapon as recited in claim 20 wherein the electrical charge that strikes the target comprises continuous series of sequential monopolar impulses, in which packets of impulses with energy of 0.05-0.15 J and a spacing frequency of 150-300 Hz alternate with packets of impulses with energy of 0.16-0.5 j and a spacing frequency of 5-30 Hz, and the duration of the cycles is determined by a set-point device.

* * * * *